US005203665A

United States Patent [19]

Lande

[11] Patent Number: 5,203,665

[45] Date of Patent: Apr. 20, 1993

[54] APPARATUS FOR REMOVING COMPOST FROM PLASTIC BAGS

[76] Inventor: Lars Lande, 11615 N. Shore Rd., Whitmore Lake, Mich. 48189

[21] Appl. No.: 775,003

[22] Filed: Oct. 11, 1991

[51] Int. Cl.[5] ..... B02C 23/02

[52] U.S. Cl. ..... 414/412; 241/200; 241/DIG. 38; 100/1; 414/528; 414/502; 414/404; 83/155; 83/409; 83/423; 83/946; 83/857; 209/644

[58] Field of Search ..... 414/411, 412, 502, 527, 414/528, 403, 404; 209/44.2, 644; 241/DIG. 38, 200; 100/1; 83/155, 409, 423, 946, 835, 857

[56] References Cited

U.S. PATENT DOCUMENTS

| | | | |
|---|---|---|---|
| 2,772,009 | 11/1956 | Plusquellic | 414/412 |
| 3,889,442 | 6/1975 | Grahn et al. | 414/412 X |
| 4,067,506 | 1/1978 | Cerroni | 241/DIG. 38 X |
| 4,183,472 | 1/1980 | Packard et al. | 241/200 |

FOREIGN PATENT DOCUMENTS

| | | | |
|---|---|---|---|
| 2359031 | 7/1976 | France | 414/412 |
| 310046 | 9/1971 | U.S.S.R. | 414/412 |
| 605753 | 5/1978 | U.S.S.R. | 414/412 |
| 825379 | 4/1981 | U.S.S.R. | 414/412 |
| 1194778 | 11/1985 | U.S.S.R. | 414/412 |
| 2060545 | 5/1981 | United Kingdom | 414/412 |
| 2189213 | 10/1987 | United Kingdom | 414/411 |

*Primary Examiner*—Frank E. Werner
*Attorney, Agent, or Firm*—Harness, Dickey & Pierce

[57] ABSTRACT

An apparatus for removing compostable materials from plastic bags. The apparatus includes a conveyor having retaining members which engage and assist the conveyor in transporting the bags of compostable materials to a discharge bin. A cutting element cooperates with the first conveyor to open the bags allowing the compostable material to be emptied from the bags at one end of the conveyor into the bin where the compostable materials are subsequently discharged onto compost piles. The bags are then removed from the retaining members and transferred into a mechanism where they are bundled for disposal or recycle.

13 Claims, 4 Drawing Sheets

APPARATUS FOR REMOVING COMPOST FROM PLASTIC BAGS

BACKGROUND AND SUMMARY OF THE INVENTION

The invention generally relates to machinery used in recycling waste and particularly to an apparatus which opens plastic bags containing compostable materials and which disperses the compostable materials onto compost piles at a large scale composting facility.

As people have become more involved with recycling, composting has increasingly become a viable alternative for the disposal of organic waste such as leaves, branches and twigs. While the small compost pile has been popular with homeowners for some time, composting has only recently gained popularity with municipalities as an effective method for reducing the volume of waste being disposed of in general landfills.

A large scale compost yard or composting facility, as would be typically used by a municipality or other community, generally includes a large tract of land having a number of compost rows or piles. Depending on the size of the municipality and the amount of composting being done, the rows may vary in size. Typically, the compost rows are about six feet in height with taller compost rows being possible.

In collections from households for composting at the community site, the compostable materials are typically received in plastic bags which are tied or otherwise closed. At the compost yard, the bags containing the compostable materials, hereinafter referred to as bales, must be manually opened. The compostable materials are then manually separated from the plastic bags and spread onto the compost piles. The process is both time consuming and labor intensive.

In view of the procedure outlined above, it is an object of the present invention to substantially automate the opening of the bales and spreading of the compostable materials. To this end, this invention provides an apparatus which efficiently and effectively opens the bales in which compostable materials are received at the compost yard. After opening the bales, the apparatus of this invention provides for the emptying and separating of the compostable materials from the plastic bags and provides for the dispersing of the compostable materials onto the rows of compost. As such, the apparatus readily disseminates the compostable materials once received at the compost yard.

In achieving these objects, the present invention generally includes an inclined conveyor of the endless belt variety. The belt of the conveyor is provided with projecting tines which, as the bales are loaded onto the conveyor, pierce the plastic bags of the bales and hold the bales in position. The bales are carried by the conveyor and a cutting element engages the bales to lengthwise cut and open the plastic bags. The cutting element also acts upon the opened bales to laterally spread the plastic bags and more fully expose the compostable materials.

At the upper end of the conveyor is a receiving bin and blower. Once an opened bale reaches the upper end of the conveyor, the tines pull the bale over the end of the conveyor, effectively dumping and emptying the compostable materials into the receiving bin. The blower is operated to disperse the compostable materials through a discharge chute formed in the receiving bin. A number of the tines are generally oriented in a direction toward the side of the apparatus to which the blower is attached. The orientation holds the bags on the tines as the blower is operated.

Once the compostable materials have been emptied, the plastic bags remain engaged on the tines and are drawn along the return or lower side of the conveyor. A rotating brush engages and removes the bags from the tines and the conveyor. The roller brush deposits the empty bags onto a second conveyor which feeds the bags into a conventional baling or bundling machine. Upon receiving an appropriate number of plastic bags, the baler produces a bale of used plastic bags which may be recycled or otherwise disposed of properly.

Additional benefits and advantages of the presen invention will become apparent to those skilled in the art t which this invention relates from the subsequent description of the preferred embodiment and the appended claims taken in conjunction with the accompanying drawings.

DETAILED DESCRIPTION OF THE PREFERRED EMBODIMENT

Figure 1:
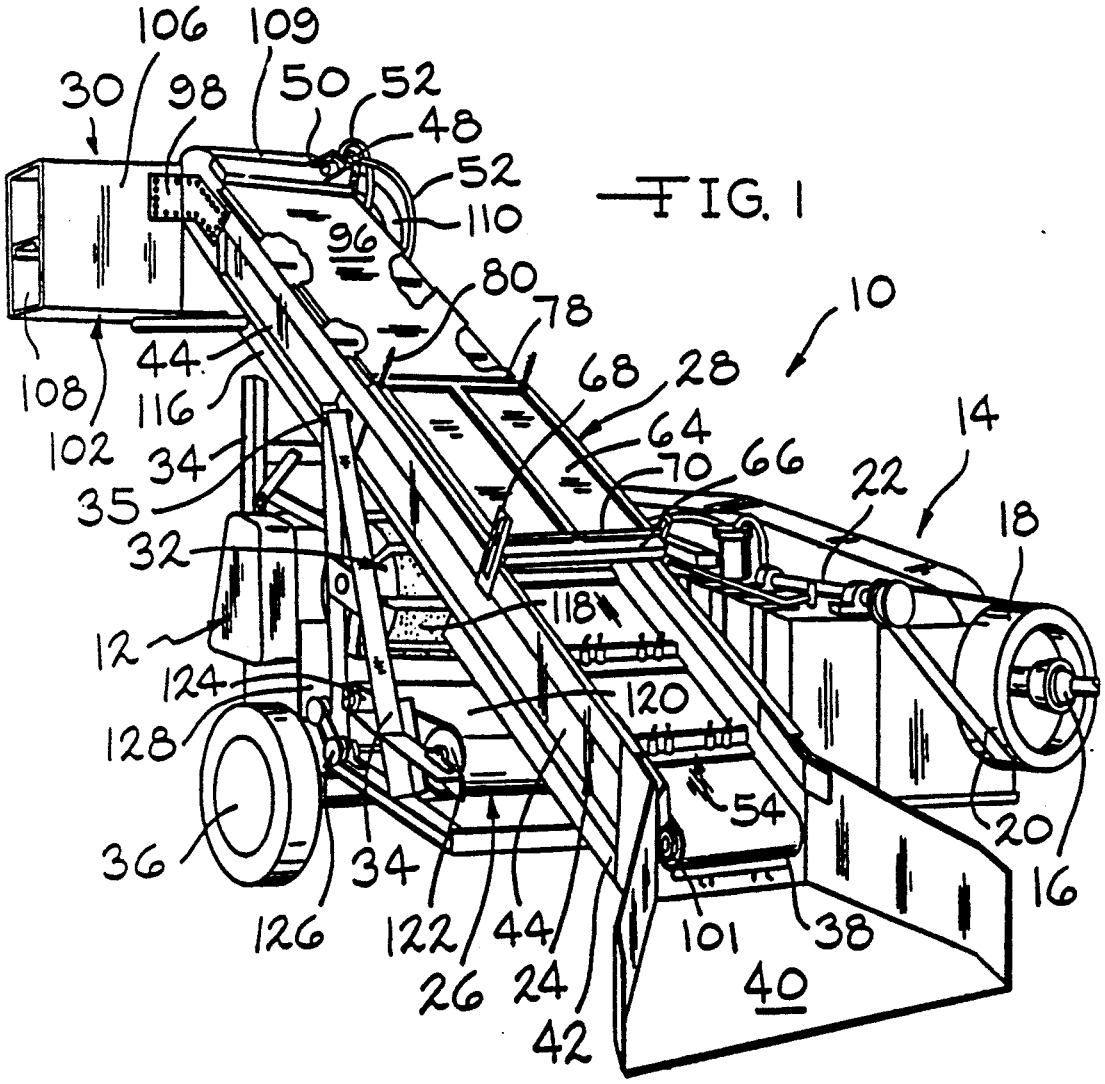
FIG. 1 is a perspective view of an apparatus embodying the principles of the present invention.

Now with reference to the drawing, an apparatus for opening and emptying plastic bags in which compostable materials are received at a compost yard, including a mechanism for discharging the compostable materials onto compost rows or piles, is shown in FIG. 1 and generally designated at 10. The apparatus 10, hereinafter referred to as a composter 10, is provided for use in conjunction with a conventional bundling mechanism or baler 12 of the hay baling variety. Since the baler 12 is of a variety well known within the field of farm machinery, the baler 12 is only generally described herein.

The baler 12 includes a drive system 14 which serves to operate the actual baling functions of the baler 12. The drive system 14 may be driven by a motor, self-contained within the baler 12 or preferably, as illustrated, by coupling the drive system 14 to the power take-off (PTO) 16 of a tractor (not shown). As illustrated in FIG. 1, the PTO 16 engages a fly wheel or pully 18 which drives a belt 20 coupled to rotate a driveshaft 22 of the drive system 14. The driveshaft 22 may be coupled to a hydraulic pump (not shown) for operating hydraulic motors, as further described below. While hydraulic pumps and motors are preferred because of their reliability, other systems, such as pneumatic, mechanical and electrical systems, could alternatively be used to operate additional aspects of the invention. In addition to the baler 12, the composter 10 includes two conveyors of the endless belt variety, hereinafter designated as primary conveyor 24 and secondary conveyor 26, an opening station 28, a discharge station 30 and a bag removal station 32, all being provided so as to cooperate with the primary conveyor 24.

The primary and secondary conveyors 24 and 26 are mounted to the baler 12 by a frame 34 which allows the primary conveyor 24 to pivot about mounting 35. The pivotable mounting 35 permits the primary conveyor 24 to be moved between an inclined operable position and a substantially horizontal inoperable position (not shown) which permits the composter 10 to be moved around the compost yard or to be trailered. To permit trailering over longer distances, the bailer 12 is provided with wheels 36, one of which is illustrated, and the primary conveyor 24 may be disconnected from the frame 34 at the pivot 35.

In its operational position, shown in FIG. 1, the primary conveyor 24 is inclined and an endless belt 38 is rotated so that the plastic bags containing the compostable materials (not shown), hereinafter referred to as bales, are transferred from a feed hopper 40, at the lower end 42 of the primary conveyor 24, to the discharge station 30 located at the upper end 98. The feed hopper 40 is mounted to a pair of opposing side walls 44 of the primary conveyor 24 and may be permanently welded to the side walls 44 or may be bolted to the side walls 44 enabling removal of the feed hopper 40. The feed hopper 40 has a flared or shovel configuration to assist in the loading of the bales onto the belt 38 of the primary conveyor 24.

The bales are placed onto the support surface defined by the belt 38 either manually or by another method which will individually feed the bales. Rotated by a chain drive system 48, the belt 38 is driven by a motor 50 which is coupled by lines 52 to the hydraulic pum mentioned above.

Figure 6:
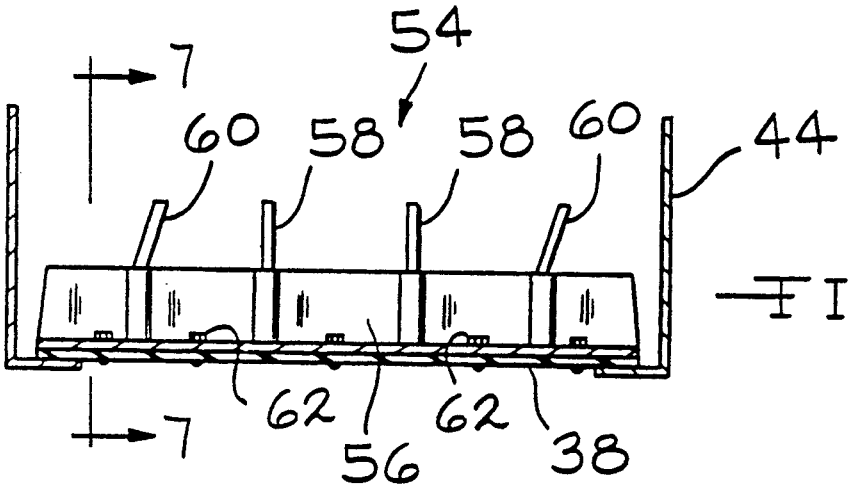
FIG. 6 is a cross sectional view illustrating the orientation of the tines utilized with the present invention.
Figure 7:
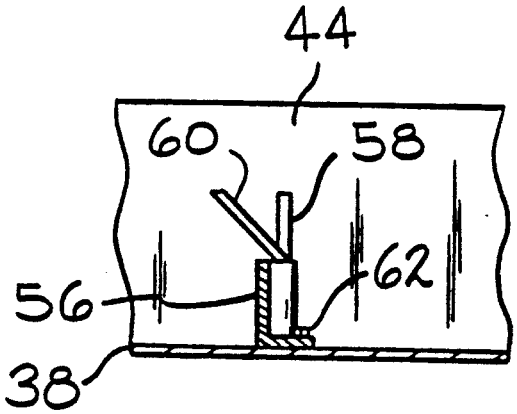
FIG. 7 is a cross sectional view substantially taken along line 7—7 in FIG. 6 further illustrating the orientation of the tines utilized with the present invention.

Bale holders 54 are provided at spaced apart intervals along the length of the belt 38 to securely hold the bales onto the belt 38. The bale holders 54 are best seen in FIGS. 6 and 7. The bale holders 54 extend across the width of the belt and include a mounting bracket 56, formed from angle iron, to which are secured a pair of straight tines 58 and a pair of angled tines 60. Bolts 62 or other suitable fasteners, are used to mount and secure the mounting bracket 56 to the belt 38.

The tines 58 and 60 extend generally upward from the belt 38 and bracket 56 so that, as a bale is loaded onto the belt 38, the weight of the bale causes the bale to become impaled upon the tines 58 and 60. In this manner, the tines 58 and 60 assist in carrying the bales up the primary conveyor 24. If a bale fails to become engaged upon the tines 58 and 60, an upwardly extending portion of the angle iron forming the next adjacent mounting bracket 56 will prevent the bale from sliding or rolling down the incline of the conveyor 24.

The straight tines 58 ar secured to the mounting bracket 56 inside of the angled tines 60. The straight tines 58 are to secure the bales as they move up the primary conveyor 24. Additionally, the straight tines 58 prevent the plastic bags themselves from rolling about or around the compostable materials as the bags are opened during engagement with the opening station 28. While only two straight tines 58 ar illustrated for each bale holder 54, a greater or lesser number may also be used. It is anticipated, however, that two will prove adequate.

The angled tines 60 are oriented so that they generally extend longitudinally forward relative to the belt, or in other words, in the direction in which the belt 38 is being rotated. In addition to extending forward, both angled tines 60 are also oriented toward a common side of the primary conveyor 24. Since the angled tines 60 extend forward relative to the belt 38, the likelihood that a bale will accidentally pull off of the tines 58 and 60 is decreased. The function and reason for the lateral orientation of the angled tines 60 is more fully discussed below.

Figure 2:
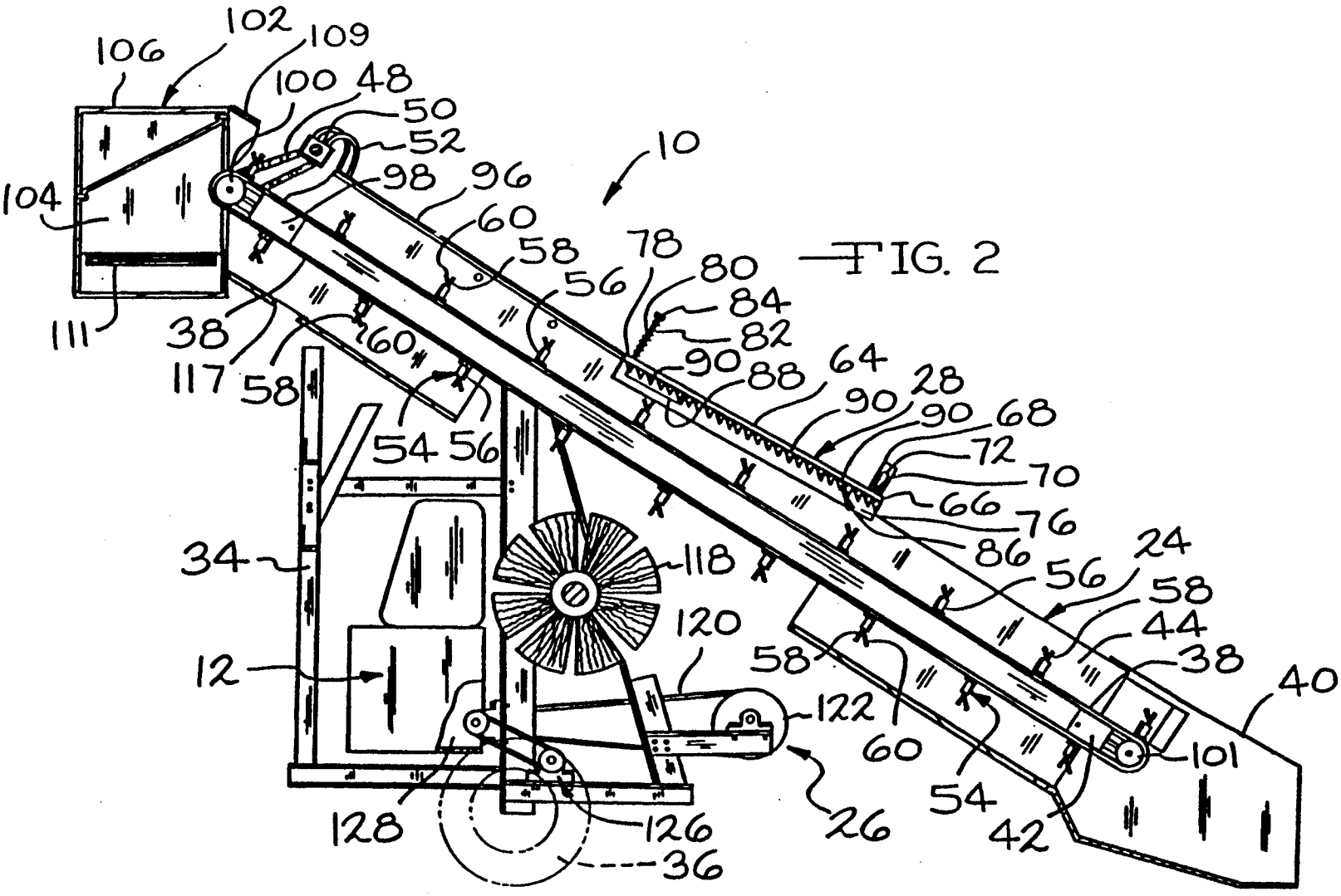
FIG. 2 is a side elevational view with portions broken away further illustrating various components of the invention shown in FIG. 1.
Figure 3:
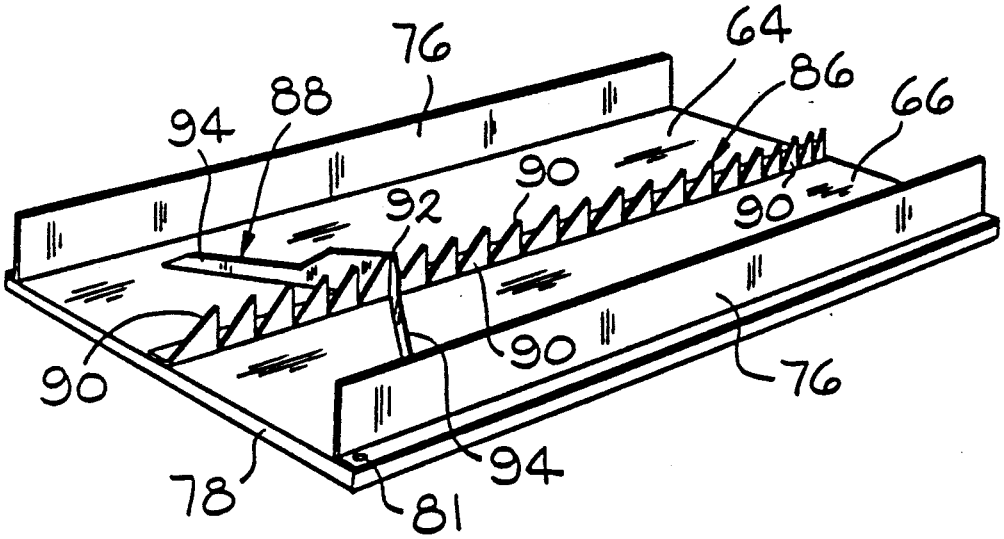
FIG. 3 is a perspective view of the underside of the cutting element utilized in conjunction with the present invention.
Figure 4:
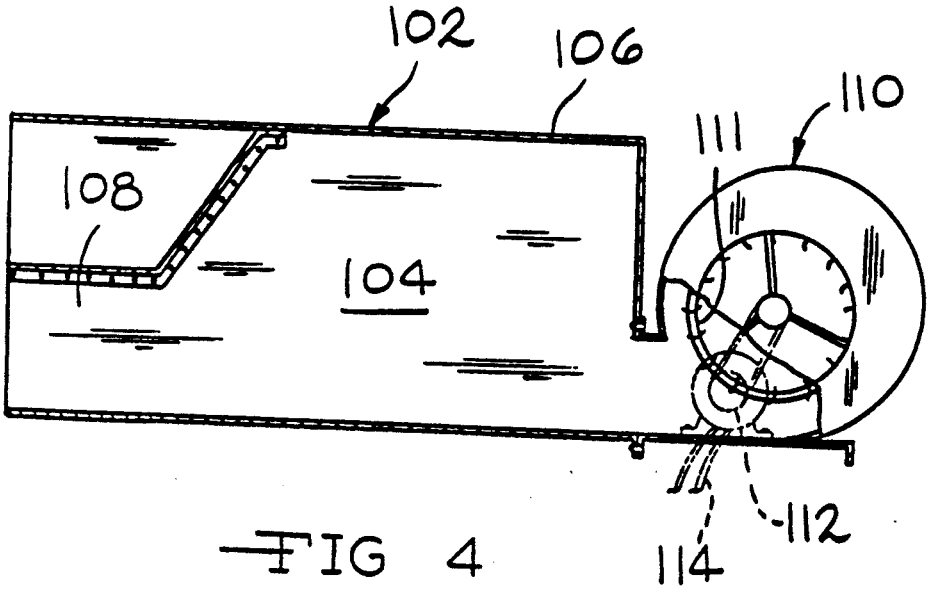
FIG. 4 is a cross sectional view of the blower and receiving bin utilized with the present invention.
Figure 5:
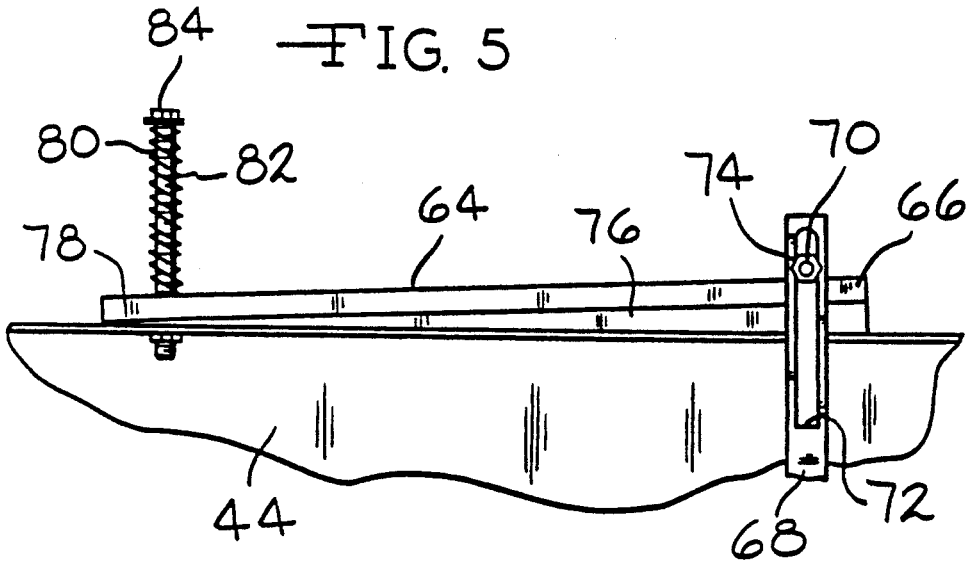
FIG. 5 illustrates the mounting mechanism for the cutting element shown in FIG. 3.

Now with reference to FIGS. 2, 3, and 5, positioned approximately midway up the incline of the primary conveyor 24 is the opening station 28. The opening station 28 includes a cutting element having backing plate 64 which is mounted between the side walls 44 of the primary conveyor 24. To compensate for variations in the thicknesses of the bales encountered at the opening station 28, the leading end 66 of the backing plate 64 is movably mounted and the trailing end 78 is deflectable. Extending between the opposing side walls 44, the backing plate 64 is mounted so as to enable varying of the height of the leading end 66 in a direction generally normal to the support surface of the belt 38. The leading end 66 of the backing plate 64 includes a rod 70, welded thereto, which is mounted within a pair of slotted brackets 68. The outboard ends of the rod 70 are threaded and extend through slots 72 formed in the slotted brackets 68. The ends of the rod 70 are engaged by nuts 74 which prevent the rod 70 from being pulled out of the slotted brackets 68. When the leading end 66 of the opening station 28 encounters a bale of increased thickness, the bale will be pulled into the opening station 28 by the tines 58 and 60 and a small amount of roll of the bag or bale may occur. The roll, along with the thickness of the bale, moves the rod 70 up along the slots 72 varying the height of the leading end 66 above the belt 38 and permitting the remainder of the bale to enter the opening station 28.

The trailing end 78 of the backing plate 64 is deflectably mounted to the primary conveyor 24 at a distance which is closer to the surface of the belt 38 than the leading end 66. To mount the trailing end 78, a post 80 extends upwardly from the side walls 44 through an opening 81 in the backing plate 64. A biasing member or spring 82 is mounted above the backing plate 64 over the post 80 and retained thereon by a nut or cap 84. Thus, the spring 82 biases the trailing end 78 of the backing plate 64 toward the belt 38 until a bale of significant thickness is encountered, at which point the trailing end 78 will be biased away from the belt 38 by the bale. As will become more apparent in view of the following discussion, the deflectable mounting of the trailing end 78 encourages engagement between the bales and the elements of the opening station 28 to ensure opening of the plastic bags.

Mounted to the backing plate 64 and extending toward the belt 38 are a cutting member or knife 86 and spreader bars 88. The knife 86 extends longitudinally along the backing plate 64 and is generally centered with respect to the width of the belt 38. As illustrated, the knife 86 includes serrations or teeth 90. However, the knife 86 could also have a single cutting edge. The spreader bar 8 is positioned generally toward the trailing end 78 of the backing plate 6 and is generally V-shaped with its apex 92 being positioned toward the leading end 66. The spreader element 88 diverges from the apex 92 along legs 94 which exhibit a decreasing height. The height of the legs 94 decrease in an amount which generally corresponds with the decrease in height exhibited by the backing plate 64 relative to the surface of the belt 38.

During operation, a bale will be carried by the bale holders 54 from the feed hopper 40 to a point where the knife 86 of the opening station 28 begins to engage with the plastic bag of the bale. As the bale continues up the primary conveyor 24, the knife 86 will longitudinally cut the plastic bag open and, as the bale reaches the spreader bars 88, the plastic bag itself will be laterally spread toward the side walls 44, substantially fully exposing the compostable materials.

The backing plate 64 is provided with downward side extensions 76 that are interiorly adjacent to the side walls 44. The side extensions 76 prevent compost material from inadvertently blowing out of the primary conveyor 24 once the bale has been opened at the cutting station 28.

As the opened bales leave the cutting station 28, a cover plate 96, extending between the opposing side walls 44 of the primary conveyor 24, will prevent the accidental and random blowing of the exposed compostable materials from the primary conveyor 24. The cover plate 96 may be secured to the side walls 44 in any convenient manner. However, it is preferred that the cover plate 96 is removably secured to readily permit servicing of the composter 10 in that area.

At its upper end 98, the belt 38 is reversed in direction over a roller 100 and returns to the lower end 43. A similarly roller 101 is located at the lower end 42 of the primary conveyor 24 to reverse the direction of the belt 38 for advancement to the upper end 98.

As the opened bales are carried over the roller 100 at the upper end 98, the compostable materials are emptied from the plastic bag into a receiving bin 102 mounted at the upper end 98 of the primary conveyor 24. The receiving bin 102 includes a housing 106 which defines a central receiving chamber 104 and a discharge chute 108. Attached to the central receiving chamber 104, opposite of the discharge chute 108, is a drum type blower 110. The blower 110 is preferably driven by a hydraulic motor 112 and is connected by lines 114 to the hydraulic pump previously mentioned. If desired, alternative drive systems may be employed to drive the blower 110. During operation of the blower 110, the compost materials received in the central receiving chamber 104 will be dispersed out of the chamber 104 through the discharge chute 108. The discharge chute 108 is smaller in size than the central receiving chamber 104 and serves to specifically direct the compostable materials onto the compost rows of the compost yard.

To prevent compostable materials from being inadvertently blown from the composter 10 as they are being emptied into the receiving bin 102, a hood 109 extends from the cover plate 96 to the housing 106 of the receiving bin 102.

The angled tines 60, as mentioned above, are oriented in a direction toward one side wall 44 of the primary conveyor 24. The side wall 44 to which the tines 60 are angled corresponds with the side of the receiving bin 102 to which the blower 110 is attached. When provided in this manner, as the blower 110 is operated and the compostable materials are emptied into the receiving bin 102, the orientation of the angled tines 60 will serve to retain the plastic bags with the primary conveyor 24 as the force of air from the blower 110 blows across the bags.

After emptying the compostable materials, the plastic bags are pulled by the tines 58 and 60 underneath the primary conveyor 24 along the return path of the belt 38. The bags remain engaged on the tines 58 and 60 and are pulled through a lower cover 116. An opening 117 is defined in the lower cover 116. Any residual compostable material remaining in the plastic bag will be emptied from the plastic bag through the opening 117 by gravity.

As the plastic bags are pulled out of an end opening in the lower cover 116, the bags are engaged by a roller brush 118 which is hydraulically coupled to the drive shaft 22 for rotation. The roller brush 118 is rotated faster than the belt 38 and, upon engaging the bags, operates to pull the plastic bags forwardly off of the tines 58 and 60 depositing the bags onto a belt 120 of the secondary conveyor 26.

Similar to the primary conveyor 24, the belt 120 of the secondary conveyor 26 is rotated by a hydraulic motor about a pair of end rollers 122 and 124. The secondary conveyor 26 transfers the plastic bags into a mouth 128 of the baler 12. As a sufficient number of plastic bags are deposited into the mouth 128 of the baler 12, the baler 12 is operated to produce a bale of plastic bags which can then be recycled or otherwise disposed of properly.

While the above description constitutes the preferred embodiment of the present invention, it will be appreciated that the invention is susceptible to modification, variation and change without departing from the proper scope and fair meaning of the accompanying claims.

What is claimed is:

1. An apparatus for removing materials from bags comprising:

a conveyor including a frame and having first and second ends, said conveyor also including a belt being operable for rotation in a direction about said first and second ends, said belt including a plurality of retaining tines being positioned at spaced apart intervals thereon, said retaining tines receiving said bags thereon and carrying said bags along said conveyor as said belt rotates, at least some of said retaining tines being angularly oriented generally toward and in the direction of rotation of said belt;

a cutting element mounted to said frame of said conveyor and being positioned relative to said belt so as to cuttingly engage said bags during rotation of said belt thereby opening said bags;

spreading means for substantially laterally spreading open said bags to expose said materials therein after said basg have been longitudinally cut open by said cutting element; and a receiving bin positioned adjacent to said second end, said materials being emptied into said receiving bin from said bags as said bags are carried about said second end, said receiving bin including a discharge portion and means for forcibly discharging said materials from said receiving bin through said discharge portion.

2. An apparatus for removing materials from bags as set forth in claim 1 wherein said cutting element includes knife means for substantially longitudinally cutting open said bags.

3. An apparatus for removing materials from bags as set forth in claim 1 wherein said spreading means includes a member having a pair of diverging legs meeting at an apex, said pair of legs being oriented and positioned to progressively engage and laterally spread said bags open.

4. An apparatus for removing materials from bags as set forth in claim 1 wherein said discharge means includes a blower attached to said receiving bin for blowing said materials from said bin and from said bags.

5. An apparatus for removing materials from bags as set forth in claim 4 wherein said blower is generally positioned to one side of said belt opposite said discharge portion.

6. An apparatus for removing materials from bags as set forth in claim 5 wherein said angularly oriented retaining tines are generally angularly oriented laterally with respect to the direction of rotation of said belt toward said one side of said belt on which said blower is positioned.

7. An apparatus for removing materials from bags as set forth in clain 1 wherein said angularly oriented retainign tines are also generally laterally oriented with respect to the direction of rotation of said belt.

8. An apparatus for removing materials from bags as set forth in claim 1 wherein at least one of said retaining members is oriented in a direction substantially normal to said belt.

9. An apparatus for removing materials from bags as set forth in claim 1 further comprising means for removing said bags from said retaining members after being emptied of said materials.

10. An apparatus for removing materials from bags as set forth in claim 1 wherein said apparatus further comprises a secondary conveyor including an endless secondary belt being mounted for rotation about first and second ends, means for rotating said secondary belt, said secondary conveyor being cooperatively positioned with said removing means to receive said bag onto said secondary belt.

11. An apparatus for removing materials from bags as set forth in claim 10 wherein said apparatus further comprises means for receiving said bags from said secondary conveyor and baling said bags into bundles.

12. An apparatus for removing materials from bags as set forth in claim 1 wherein said apparatus further comprises means for preventing said materials from inadvertently being emptied from said bags and said conveyor after opening and prior to emptying into said receiving bin.

13. An apparatus for removing materials from bags as set forth in claim 12 wherein said preventing means includes a cover member extending over said conveyor.

* * * * *